United States Patent [19]

Chalk et al.

[11] Patent Number: 4,565,757

[45] Date of Patent: Jan. 21, 1986

[54] PHOTOCONDUCTIVE COMPOSITIONS SENSITIVE TO BOTH LASER LIGHT AND TUNGSTEN HALIDE LIGHT

[75] Inventors: Anthony J. Chalk, Leeds; Graham Charnock, Huddersfield; Allen P. Gates, Knaresborough; David E. Murray, Leeds; Ian S. Smith, Bradford, all of England

[73] Assignee: Vickers PLC, England

[21] Appl. No.: 562,696

[22] Filed: Dec. 15, 1983

[30] Foreign Application Priority Data

Dec. 16, 1982 [GB] United Kingdom ..... 8235884

[51] Int. Cl.[4] ..... G03G 5/04

[52] U.S. Cl. ..... 430/83; 430/95

[58] Field of Search ..... 430/79, 81, 83, 95

[56] References Cited

U.S. PATENT DOCUMENTS 3,932,418 1/1976 Janssens et al. ..... 430/79

4,063,948 12/1977 Lind ..... 430/81

4,415,641 11/1983 Goto et al. ..... 430/79

*Primary Examiner*—John L. Goodrow

*Attorney, Agent, or Firm*—Spensley Horn Jubas & Lubitz

[57] ABSTRACT

A photoconductive composition comprises a photoconductor and a sensitizer. The sensitizer has the formula

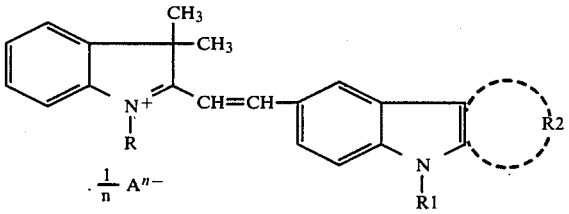

wherein R represents alkyl; R1 represents H, alkyl or aryl; R2 represents the atoms required to complete a hetero or carboxyclic ring; $A^-$ represents an anion; and n represents the valency of the anion. The composition is sensitive to both laser light sources and tungsten light sources and is useful in electrophotographic reproduction.

9 Claims, No Drawings

PHOTOCONDUCTIVE COMPOSITIONS SENSITIVE TO BOTH LASER LIGHT AND TUNGSTEN HALIDE LIGHT

This invention relates to a photoconductive composition for use in electrophotographic reproduction.

The use of photoconductive compositions comprising organic photoconductors having a spectral sensitivity in the range 350 to 450 nm for electrophotographic reproduction is proposed in GB Patent Specification No. 851218. This range may be extended to longer wavelengths by the incorporation of various sensitising dyestuffs to enable the photoconductive composition to be exposed to the tungsten halide lamps used in a graphic arts reproduction camera.. Rhodamine type dyes are commonly used for this purpose.

More recently, the use of lasers, particularly argon-ion lasers, as exposure sources has become increasingly important. Such lasers emit light in the blue/green region of the spectrum and have strong lines at 488 and 514.5 nm and it has been suggested that photoconductive compositions can be sensitised to light of this wavelength by incorporating certain polymethine dyestuffs having the structure

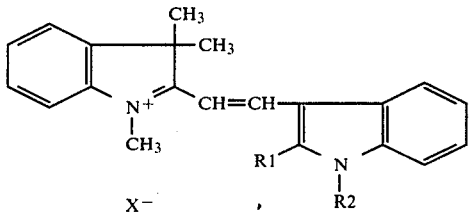

where R1 is methyl or phenyl, R2 is hydrogen or methyl and X is a halide. A particular example of such a dye is CI Basic Orange 22.

Whilst such dyes are satisfactory as regards laser exposure, they do not provide sufficient sensitivity to tungsten halide light sources to enable the compositions to be used efficiently with either source.

It is an object of this invention to provide a photoconductive composition that is suitable for exposure by either argon-ion laser or tungsten halide light.

According to the invention, there is provided a photoconductive composition comprising at least one photoconductor and, as sensitiser, a compound having the formula:

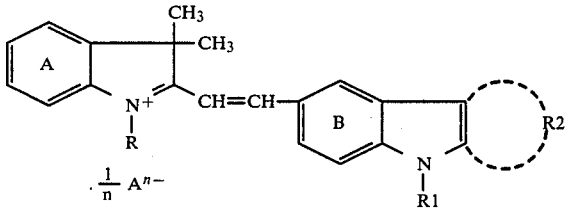

wherein

R represents alkyl;

R1 represents alkyl or aryl;

R2 represents the atoms required to complete a hetero or carbocyclic ring; and $A^{n-}$ represents an anion.

The benzene rings A and B, and the ring formed by R2 may be substituted.

Preferred sensitisers are:

1. 2-[2-(9-ethyl-3-carbazolyl)-vinyl]-1,3,3-trimethyl-3H-indolium tetrafluoroborate.
2. 2-[2-(9-ethyl-3-carbazolyl)-vinyl]-1,3,3-trimethyl-5-nitro-3H-indolium tetrafluoroborate.
3. 2-[2-(9-ethyl-3-carbazolyl)-vinyl]-1,3,3-trimethyl-5-chloro-3H-indolium chloride.
4. 2-[2-(6-bromo-9-ethyl-3-carbazolyl)-vinyl]-1,3,3-trimethyl-3H-indolium hexafluorophosphate.
5. 2-[2-(2-ethoxy-9-ethyl-3-carbazolyl)-vinyl]-1,3,3-trimethyl-3H-indolium tetrafluoroborate.
6. 2-[2-(5,6,7,8-tetrahydro-9-ethyl-3-carbazolyl)-vinyl]-1,3,3-trimethyl-3H-indolium tetrafluoroborate.
7. 2-[2-(6-diethylamino-9-ethyl-3-carbazolyl)-vinyl]-1,3,3-trimethyl-3H-indolium trifluoromethane sulphonate.
8. 2-[2-(9-phenyl-3-carbazolyl)-vinyl]-1,3,3-trimethyl-3H-indolium p-toluene sulphonate.
9. 2-[2-(9-propyl-6-pyrido[2,3-b]indolyl)-vinyl]-1,3,3-trimethyl-3H-indolium tetrafluoroborate.
10. 2-[2-(4-ethyl-7-thieno[3,2-b]indolyl)-vinyl]-1,3,3-trimethyl-3H-indolium chloride.

The composition preferably contains from 0.01 to 10% by weight, preferably from 2 to 5% by weight, of sensitiser, based on the photoconductor.

The composition of the invention is especially intended for use in the electrophotographic production of printing formes and printed circuits, and may be applied to a support which may comprise any material suitable for this purpose, for example, aluminium, zinc, magnesium or copper plates or multi-metal plates, wherein a multi-metal plate is one which comprises a combination of 2 or more metals, and also cellulose products, for example, special papers, cellulose hydrate, cellulose acetate or cellulose butyrate films, especially partially saponified cellulose acetate or butyrate films. Some plastics material, for example, polyamides in film form or metal-vaporised films, are suitable for use as support. Grained and anodised aluminium is particularly suitable for the support.

Preferred photoconductors for use in the composition are those amino-phenyl-substituted oxazoles mentioned in British Patent Specification No. 874,634, for example 2-phenyl-4-(2'chlorophenyl-5-(4"diethylaminophenyl)-oxazole. Other suitable photoconductors include, for example triphenylamine derivatives, higher condensed aromatic compounds, such as anthracene, benzo-condensed heterocyclic compounds, and pyrazoline or imidazole derivatives. Also suitable are triazole and oxadiazole derivatives, as disclosed in British Patent Specification Nos. 836,148 and 851,218; 2,5-bis-(4'-diethylaminophenyl)-1,3,4-oxadiazole is particularly suitable here. In addition, vinyl-aromatic polymers such as polyvinyl anthracene, polyacenaphthylene, poly-N-vinylcarbazole and copolymers of these compounds are suitable, particularly those that contain hydrophilic groups. Also suitable are polycondensates of aromatic amines and aldehydes, as described in British Patent Specification No. 977,399 and resins as described in British Patent Specification No. 1404829.

The composition preferably also contains one or more natural or synthetic resin binders. In addition to having film-forming and electrical properties, and also adhesion to the support, the resins should also have good solubility properties. For practical purposes, the resin binders which are particularly suitable are those which are soluble in essentially aqueous or solvent systems. Aromatic or aliphatic, easily combustible solvents are excluded for physiological and safety reasons. The most suitable resin binding agents are high-molecular substances carrying alkali-solubilising groups. Such groups are, for example, carboxyl, phenol, sulphonic acid, sulphonamide sulphonimide groups and also acid anhydride groups.

Partial esters of copolymers of styrene and maleic acid anhydride, for example, those known under the name Scripset (Registered Trade Mark), Monsanto Co., United States, are especially suitable; also phenol resins. for example those known under the name Alnovol (Registered Trade Mark), Hoechst AG., Germany, have proved very satisfactory.

Additional sensitising dyes for example, triarylmethane dyes, xanthene dyes, polymethine dyes, phthalein dyes, pyrylium and thiopyrylium dyes, quinoline dyes, thiazine dyes, acridine dyes, and quinone dyes may be included in the composition to extend the spectral response.

The anion may be halide, e.g. chloride or bromide, tetrafluoroborate, toluene sulphonate, hexafluorophosphate, trifluoromethane sulphonate, lauryl sulphate, methyl sulphate and methyl sulphonate.

The sensitisers may be prepared by reacting a Fischer's base with a suitable aldehyde in glacial acetic acid and heating under reflux. After cooling, the product may be precipitated by the addition of an aqueous solution containing a suitable anion.

Thus, for example, 2-[2-(9-ethyl-3-carbazolyl)-vinyl]-1,3,3-trimethyl-3H-indolium tetrafluoroborate was prepared by mixing 1,3,3-trimethyl-2-methylene indoline (0.01 mole) and 9-ethyl-3-carbazolecarboxaldehyde (0.01 mole) in glacial acetic acid (30 ml) and heating under reflux for 2 hours. The solution was allowed to cool to room temperature and then poured into water (600 ml). The product was precipitated by the addition of a solution of sodium tetrafluoroborate (12 g) in water (40 ml) and then filtered, washed with water and dried at 60 degC. The product had a melting point of 216–218 degC. Similarly 2-[2-(9-ethyl-3-carbazolyl)-vinyl]-1,3,3-trimethyl-5-chloro-3H-indolium chloride (melting point 226–228 degC.) may be prepared using the 5-chloro derivative of the above Fischer's base and sodium chloride solution as the precipitating agent.

The following examples illustrate the invention:

EXAMPLE 1

A coating solution was prepared by dissolving 2,5-bis-(4'-diethylaminophenyl)-1,3,4-oxadiazole (40 g), Scripset 540 (60 g) and sensitiser 1 (1.5 g) in methyl ethyl ketone (850 ml). This was applied to a 0.30 mm thick aluminium substrate which had been electrochemically grained and anodised.

After evaporation of the solvent the coated substrate was baked at 120 degC. for 5 minutes. This produced a photoconductive layer with a coating weight of 5–6 g/m2. The region of electrophotographic sensitivity was 440–620 nm having a broad peak centred at 508 nm. The layer was charged, using a corona wire, to a surface potential of −550 V. The device was imagewise exposed to 25 microjoules/cm2 of light energyat 488 nm from an argon-ion laser. The resulting latent electrostatic image was developed using a conventional magnetic brush toner. Radiant heat was used to fuse the toner powder in the image areas and an aqueous alkali wash removed the background layer. The resulting lithographic plate was washed with water, gummed, dried and used to produce several thousand prints on an offset printing press.

The electrophotographic layer was also exposed in a repro camera, to a positive original, after charging with a corona wire to a surface potential of −550 V. An exposure time of 21s was required when using 4×1000 watt tungsten halide lamps. The layer was then processed in the manner previously mentioned.

EXAMPLE 2

A coating solution was prepared by dissolving 2,5-bis-(4'-diethylaminophenyl)-1,3,4 oxadiazole (50 g) Scripset 540 (50 g), sensitiser 1 (1 g) and CI Basic Violet 16 (1 g) in methyl ethyl ketone (850 cm). This was applied to a 0.03 mm aluminium substrate which had been electrochemically grained and anodised. After evaporation of the solvent the coated substrate was baked at 120 degC. for 5 minutes. This produced a photoconductive layer with a coating weight of 5–6 g/m. The region of sensitivity was 440–650 nm. After charging the layer, with a corona wire, and exposure by Argon Ion laser or repro camera a lithographic printing plate was prepared by the method described for example 1.

EXAMPLE 3

Example 1 was repeated except that sensitiser 2 was used and the photoconductor was 2-phenyl-4-(2'chlorophenyl)-5-(4" diethyl amino phenyl)-oxazole.

Results similar to those of Example 1 were obtained.

EXAMPLE 4

A series of solutions was prepared consisting of 2-phenyl-4-82'-chlorophenyl)-5-(4"-diethyl aminophenyl)-oxazole (4 g), Scripset 540 (6 g), a sensitiser (0.1 g) and 85 ml ethyl methyl ketone. The solutions were coated on electrochemically grained and anodised aluminium substrates as described in Example 1 and the various characteristics of the plates as indicated in Table I were investigated as follows;

the wavelength of maximum absorbance (λmax) and the absorption spectral range (λrange) were measured by reflectance on a Perkin Elmer spectrophotometer;

the light energy in microjoules/cm2 ($E\frac{1}{2}$) required to discharge the surface potential to one half its initial value was measured on a Princeton Electrodynamics Inc Static Analyser. The samples were charged in the dark to a surface voltage of −550 volts and then exposed to an unfiltered tungsten lamp of colour temperature 2810 deg K. at an illumination of (269 lux.).

The plates contained sensitiser as follows:

| | |
|---|---|
| Plate 1 | Sensitiser 1 |
| Plate 2 | Sensitiser 2 |
| Plate 3 | Sensitiser 3 |
| Plate 4 | Sensitiser 4 |
| Plate 5 | Sensitiser 5 |
| Plate 6 | Sensitiser 6 |
| Plate 7 | CI Basic Orange 22 |
| Plate 8 | Solvent Red 49 (Rhodamine Base FB) |
| Plate 9 | No sensitiser |

TABLE I

| Plate | λ max (nanometers) | λ range (nanometers) | $E\frac{1}{2}$ (micro J/cm2) |
|---|---|---|---|
| 1 | 508 | 440–620 | 23 |
| 2 | 550 | 455–660 | 29 |
| 3 | 524 | 450–625 | 23 |

TABLE I-continued

| Plate | λ max (nanometers) | λ range (nanometers) | E ½ (micro J/cm2) |
|---|---|---|---|
| 4 | 490 | 440–590 | 29 |
| 5 | 527 | 440–615 | 26 |
| 6 | 518 | 440–610 | 28 |
| 7 | 495 | 440–550 | 34 |
| 8 | 564 | 470–620 | 23 |
| 9 | — | — | 400 |

Two further samples of each of plates 1, 3, 7 and 8 were charged as above. One sample of each plate was exposed in a reproduction camera to 4×1000 watt tungsten halide lamps and the other sample of each plate was exposed to an argon-ion laser. The camera exposure time and the laser energy required for the exposed plates to reach a voltage at which they did not accept toner when processed as described in Example I were measured and the results are shown in Table II.

TABLE II

| Plate | Camera Exposure Time (seconds) | Laser energy (micro J/cm2) |
|---|---|---|
| 1 | 21 | 25 |
| 3 | 22 | 25 |
| 7 | 37 | 25 |
| 8 | 25 | 67 |

These results clearly show that the sensitisers of the invention (1) are comparable in terms of argon-ion laser exposure to the polymethine dyes, (2) are comparable in terms of camera exposure to the rhodamin dyes usually used to sensitise photoconductive compositions to tungsten halide light, (3) are superior to the polymethine dyes for camera exposure and (4) are superior to the rhodamins for laser exposure.

The sensitisers used in this Example have the following structures:

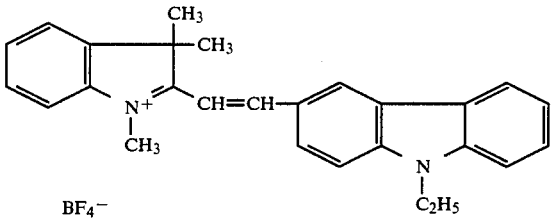

1. 2-[2-(9-ethyl-3-carbazolyl)-vinyl]-1,3,3-trimethyl-3H—indolium tetrafluoroborate.

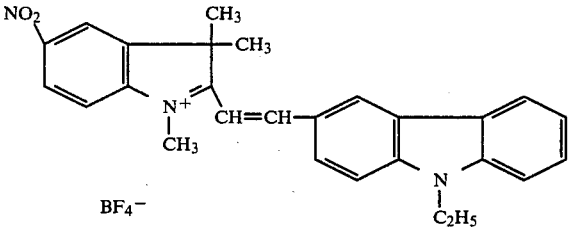

2. 2-[2-(9-ethyl-3-carbazolyl)-vinyl]-1,3,3-trimethyl-5-nitro-3H—indolium tetrafluoroborate.

-continued

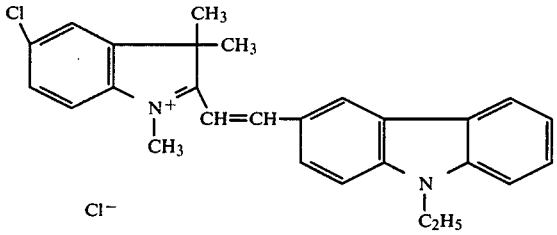

3. 2-[2-(9-ethyl-3-carbazolyl)-vinyl]-1,3,3-trimethyl-5-chloro-3H—indolium chloride.

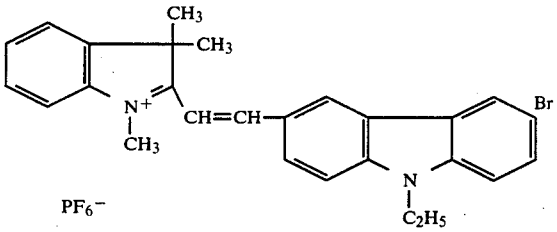

4. 2-[2-(6-bromo-9-ethyl-3-carbazolyl)-vinyl]-1,3,3-trimethyl-3H—indolium hexafluorophosphate.

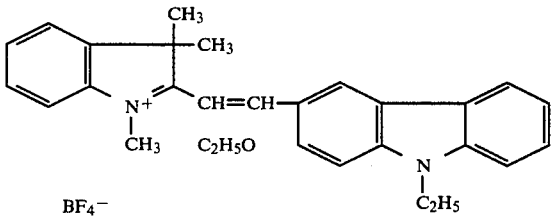

5. 2-[2-(2-ethoxy-9-ethyl-3-carbazolyl)-vinyl]-1,3,3-trimethyl-3H—indolium tetrafluoroborate.

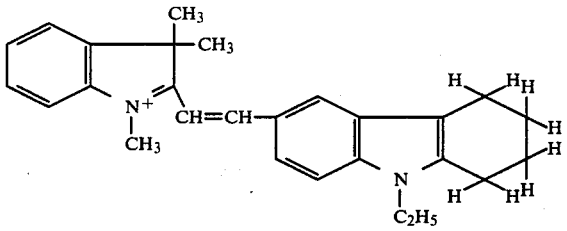

6. 2-[2-(5,6,7,8-tetrahydro-9-ethyl-3-carbazolyl)-vinyl]-1,3,3-trimethyl-3H—indolium tetrafluoroborate.

We claim:

1. A photoconductive composition comprising at least one photoconductor and, as sensitiser, a compound having the formula;

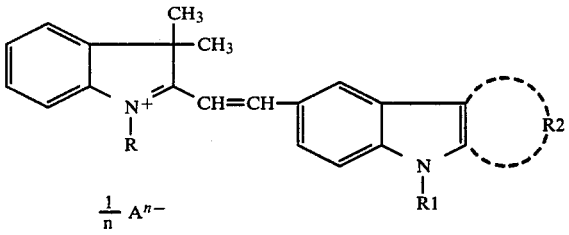

wherein R represents alkyl; R1 represents alkyl or aryl; R2 represents the atoms required to complete a hetero or carbocylic ring and $A^{n-}$ represents an anion.

2. A composition according to claim 1 in which the sensitiser compound is

2-[2-(9-ethyl-3-carbazolyl)-vinyl]-1,3,3-trimethyl-3H-indolium tetrafluoroborate; 2-[2-(9-ethyl-3-carbazolyl)-vinyl]-1,3,3-trimethyl-5-nitro-3H-indolium tetrafluoroborate; 2-[2-(9-ethyl-3-carbazolyl)-vinyl]-1,3,3-trimethyl-5-chloro-3H-indolium chloride; 2-[2-(6-bromo-9-ethyl-3-carbazolyl)-vinyl]-1,3,3-trimethyl-3H-indolium hexafluorophosphate; 2-[2-(2-ethoxy-9-ethyl-3-carbazolyl)-vinyl]-1,3,3-trimethyl-3H-indolium tetrafluoroborate; 2-[2-(5,6,7,8-tetrahydro-9-ethyl-3-carbazolyl)-vinyl]-1,3,3-trimethyl-3H-indolium tetrafluoroborate; 2-[2-(6-diethylamino-9-ethyl-3-carbazolyl)-vinyl]-1,3,3-trimethyl-3H-indolium trifluoromethane sulphonate; 2-[2-(9-phenyl-3-carbazolyl)-vinyl]-1,3,3-trimethyl-3H-indolium p-toluene sulphonate; 2-[2-(9-propyl-6-pyrido[2,3-b]indolyl)-vinyl]-1,3,3-trimethyl-3H-indolium tetrafluoroborate; 2-[2-(4-ethyl-7-thieno[3,2-b]indolyl)-vinyl]-1,3,3-trimethyl-3H-indolium chloride.

3. A composition according to claim 1 containing 0.01% to 10% by weight of sensitiser, based on the photoconductor.

4. A composition according to claim 3, containing 2–5% by weight of sensitiser based on the photoconductor.

5. A composition according to claim 1, in which the photoconductor is an oxazole, or an oxadiazole.

6. A composition according to claim 5, in which the photoconductor is 2-phenyl-4-(2'chloro phenyl)-5-(4''diethylaminophenyl)-oxazole or 2,5-bis-(4'diethylamino)-1,3,4 oxadiazole.

7. A composition according to claim 1 including a resin binder.

8. A composition according to claim 1 in which the anion is chloride, bromide tetrafluoroborate, hexafluorophosphate, p-toluene sulphonate, lauryl sulphate, methyl sulphate or methyl sulphonate.

9. A composition according to claim 1 including at least one additional sensitising dye.

* * * * *